US006035813A

United States Patent [19]

Johnstone

[11] Patent Number: 6,035,813

[45] Date of Patent: Mar. 14, 2000

[54] ENGINES OF RECIPROCATING PISTON TYPE

[75] Inventor: Ian David Johnstone, Steyning, United Kingdom

[73] Assignee: Ricardo Consulting Engineers Limited, West Sussex, United Kingdom

[21] Appl. No.: 09/176,820

[22] Filed: Oct. 22, 1998

[30] Foreign Application Priority Data

Oct. 23, 1997 [GB] United Kingdom ..... 9722449

[51] Int. Cl.[7] ..... F02F 1/00

[52] U.S. Cl. ..... 123/41.74; 123/41.81; 123/193.3

[58] Field of Search ..... 123/41.74, 41.79, 123/193.2, 41.81, 41.72, 193.3

[56] References Cited

U.S. PATENT DOCUMENTS 5,809,946 9/1998 Abe ..... 123/41.74

*Primary Examiner*—Noah P. Kamen

*Assistant Examiner*—Hai Huynh

*Attorney, Agent, or Firm*—McAulay Nissen Goldberg Kiel & Hand, LLP

[57] ABSTRACT

An engine of reciprocating piston type includes a cylinder block which defines one or more cylinders and connected to which is a cylinder head closing the cylinders. Each cylinder reciprocably receives a respective piston and is defined by a respective cylinder barrel which is integral with the remainder of the cylinder block only at one or both ends. The remainder of the length of the cylinder barrel is spaced from the remainder of the cylinder block in the radial direction by a gap which constitutes a cooling passage. The wall of the cylinder barrel affords a plurality of circumferentially spaced ribs extending in the longitudinal direction of the cylinder lining over at least a proportion of its length.

5 Claims, 1 Drawing Sheet

ENGINES OF RECIPROCATING PISTON TYPE

FIELD OF THE INVENTION

The present invention relates to internal combustion engines of reciprocating piston type and is concerned with the cylinder block, and particularly the cylinder barrels, of such engines. More specifically, the invention relates to engines of reciprocating piston type including a cylinder block which defines one or more cylinders, and connected to which is a cylinder head closing the cylinders, each cylinder reciprocably receiving a respective piston and being defined by a respective cylinder barrel which is integral with the remainder of the cylinder block only at, or near, one or both ends, the remainder of the length of the cylinder barrel being spaced from the remainder of the cylinder block in the radial direction by a gap which constitutes a coolant passage.

DESCRIPTION OF THE PRIOR ART

The cylinder head is conventionally connected to the cylinder block by a number of threaded bolts which pass through holes in the cylinder head and are received in threaded bores in the cylinder block. When these bolts are tightened, local distortion of the cylinder barrels occurs which results in their shape differing slightly from the truly cylindrical. This distortion results in an increase in "blow-by", that is to say the passage of gases past the piston into the lower portion of the cylinder barrel and an increase in oil "carry over", that is to say in the volume of oil which flows past the piston rings into the combustion space and thus in an increase in the smoke emissions from the engine. For these reasons it is known to be desirable to make the cylinder barrels as thick as possible so as to make them as stiff as possible and thus better to resist the clamping loads applied to them by the connecting bolts and less subject to local distortion.

However, in order to maximise the durability of the piston and to improve the combustion characteristics, it is desirable to make the cylinder barrels as thin as possible so as to maximise the rate of heat transfer from the internal surface of the cylinder barrels to the cooling water surrounding them. It is also desirable to make them thin from the point of view of reducing the engine weight. These two conflicting requirements have always meant in practice that the thickness of the walls of cylinder barrels has always been a compromise and this thickness is typically of the order of 7 mm.

The problem of the carry over of oil and consequent smoke generation was acceptable in the past but is becoming increasingly unacceptable as environmental emissions requirements become ever stricter. Consumers are also demanding ever higher levels of power output and the problems of barrel distortion are being exacerbated by the current trend towards increasing maximum cylinder pressures.

Accordingly it is the object of the present invention to provide an engine of the type referred to above in which the problems discussed above are significantly reduced.

SUMMARY OF THE INVENTION

According to the present invention an engine of the type referred to above is characterised in that the wall of the cylinder barrel affords a plurality of spaced portions of increased thickness extending over at least a proportion of its length.

It is preferred that the portions of increased thickness constitute ribs extending substantially parallel to the axis of the associated cylinder. It is preferred also that the cylinder head is connected to the cylinder block by a plurality of threaded fastening bolts which are received in threaded bosses integral with the cylinder block. In practice, each cylinder barrel will be adjacent two or more threaded bosses and it may be provided with a portion of increased thickness in the vicinity of each adjacent threaded boss. Each cylinder barrel may be adjacent to four threaded bosses and be provided with four portions of increased thickness adjacent thereto. However, it may be desirable to provide a greater number of threaded bosses, e.g. six, associated with each cylinder but four portions of increased thickness may well be sufficient. In this event the portions of increased thickness may not be associated with or adjacent any particular threaded boss.

The portions of increased thickness or ribs preferably have a thickness in the radial direction of the associated cylinder of 2 to 6 mm greater than that of he remainder of the cylinder barrel. This means that if the cylinder barrel has a nominal thickness of e.g. 7 mm, its thickness in the region of the thickened portions will be 9 to 13 mm. The portions of increased thickness preferably have a dimension in the circumferential direction of the associated cylinder of 5 to 15 mm.

The ribs may extend up to the top of the cylinder barrels or alternatively they may terminate somewhat short of the top of the cylinder barrels, i.e. substantially at a position which equates to the maximum height in the cylinder reached by the piston ring, or the uppermost piston ring, i.e. the height reached at the top dead centre position, because the surface of the cylinder is not in contact with the piston rings above this point. Similarly, whilst the ribs may extend to the bottom of the cylinder barrels this is not necessary because the lower portions of the cylinder barrels are inherently subjected to much lower working pressures than the upper portions during the working strokes of the associated pistons. It is therefore sufficient in practice if the portions of increased thickness have a length in the axial direction of the associated cylinder of 20 to 50 mm.

Thus the invention resides in the recognition that the requirement for additional thickness of the cylinder barrels in order to minimise the distortion caused by the clamping loads applied by the fastening bolts can be satisfied by making the barrels thicker only locally, e.g. in the region of the clamping bolts, and not over their entire circumference. This results in the cylinder barrels having different thicknesses at different positions and whilst this is directly contrary to the established wisdom which requires that cylinder barrels be of constant thickness throughout in order to minimise temperature differentials, it is found in fact that this surprisingly does not cause a problem. Accordingly the cylinder barrels are locally relatively thick to provide high mechanical stiffness and generally relatively thin elsewhere to provide adequate heat transfer.

Further features of the invention will be apparent from the following description of a four cylinder spark ignited piston engine in accordance with the invention which is given by way of example with reference to the accompanying schematic drawings.

DESCRIPTION OF THE PREFERRED EMBODIMENT

Figure 1:
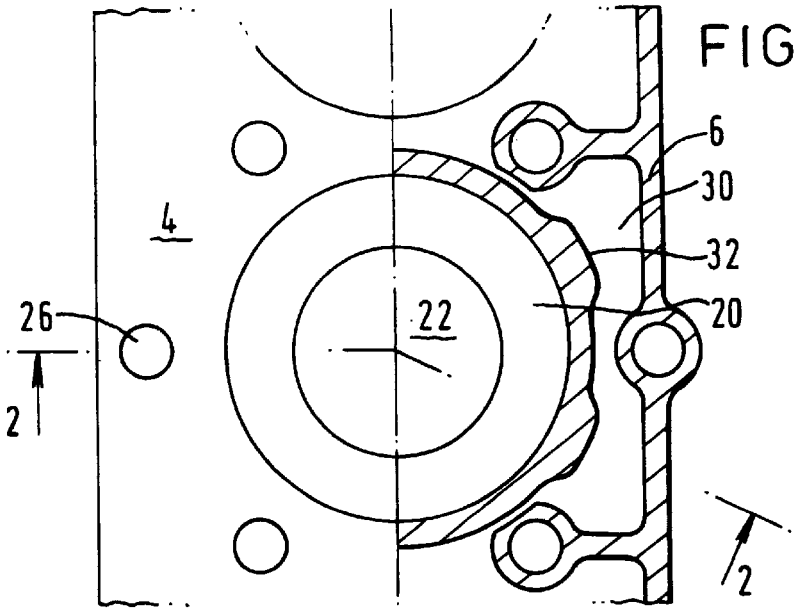
FIG. 1 is a scrap plan view, partly in section, on the line 1—1 in FIG. 2 of part of the cylinder block of the engine.

The engine comprises a cylinder block 3 with top wall 4 affording a plane substantially rectangular upper surface 5, two side walls 6, two end walls (not shown) and an opening at the base 8 which is covered by an oil pan (not shown). Integrally cast with the top wall 4 and base 8 are four equispaced cylinder barrels 10 of which only one is shown and which are spaced from the side walls and open out through the upper surface to define respective cylinders 12. Connected to the cylinder block is a cylinder head 14 with a lower surface 16 which firmly abuts the upper surface 5 of the cylinder block with the interposition of a cylinder head gasket (not shown). Reciprocably accommodated in the cylinders are respective pistons 20, which in this case have a combustion chamber recess 22 formed in their crown, and provided in the cylinder head are inlet and outlet valves (not shown). These features are well known per se and form no part of the present invention and will therefore not be discussed in more detail.

Figure 2:
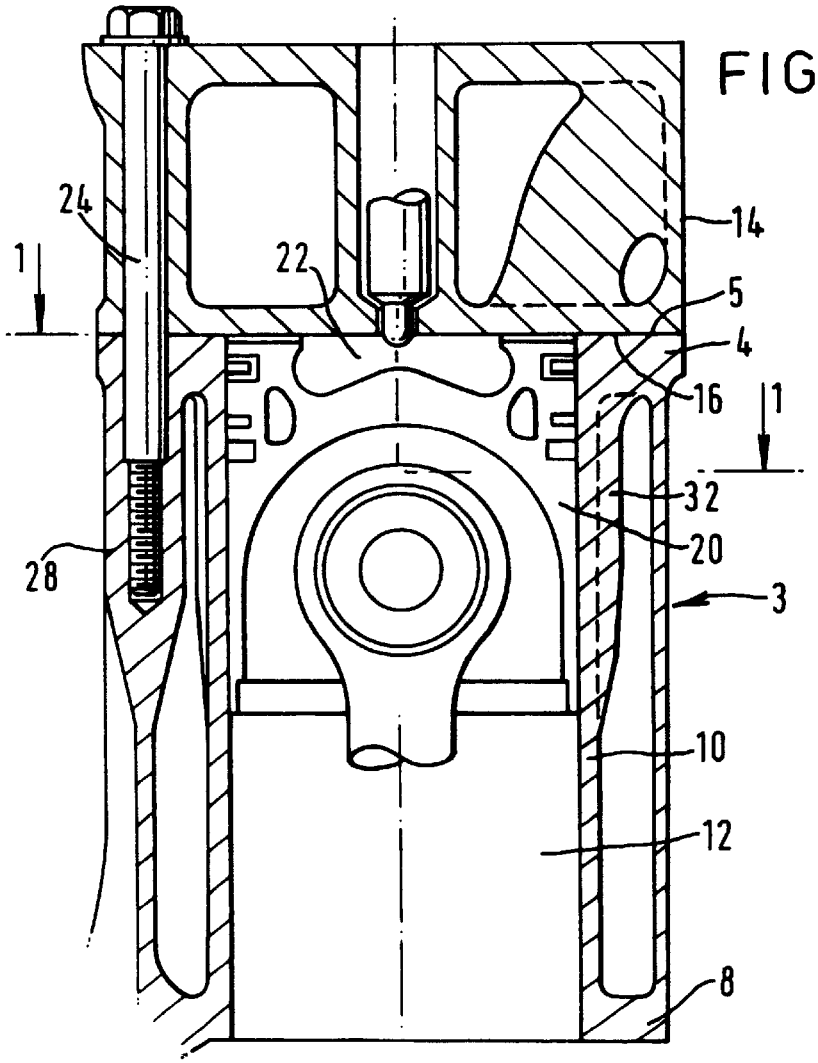
FIG. 2 is a vertical sectional view of the cylinder block of FIG. 1 on the line 2—2 in FIG. 1.

The cylinder head 14 is connected to the cylinder block 3 by a plurality of threaded fastening bolts 24, of which only one is shown in FIG. 2. Each bolt 24 passes through a respective hole 26 in the cylinder head and the upper surface of the cylinder block and is received in a respective internally threaded boss 28 integral with the top and base of the block. In this case there are six bosses associated with each cylinder, two lying on a diametral line extending perpendicular to the length of the cylinder block and the other four being associated in pairs on opposite sides of the diametral line and associated also with the adjacent cylinder. The six bosses associated with each cylinder are substantially equiangularly offset from each other with respect to the axis of the cylinder barrel.

The cylinder barrels are spaced from the side and end walls of the cylinder barrel to define a coolant space 30 through which, in use, coolant flows to maintain the cylinder barrels and the pistons within them at an acceptable temperature. The cylinder barrels constitute hollow cylinders which are integral with the remainder of the cylinder block at their ends and have a nominal wall thickness of typically 7 mm. However, each cylinder barrel is provided with four portions 32 of increased thickness in the nature of longitudinally extending ribs. Each rib extends downwardly about 30 to 50 mm from the underside of the top wall 4 of the cylinder block. Each thickened portion is typically 10 mm thick, i.e. 3 mm thicker than the remainder of the barrel, and has a circumferential extent of about 10 mm.

When the fastening bolts are tightened the cylinder liners are subject to maximum distortion in the vicinity of the bolts, i.e. in the vicinity of the bosses. In order to counteract this the ribs are conveniently located as close to the bosses as possible. Ideally the ribs would be radially aligned with the bosses but this may lead to an unacceptable constriction of the coolant space at these points and it is therefore necessary in practice for the ribs to be slightly angularly offset from the bosses by e.g. 10° to 20°.

It will be appreciated that numerous modifications may be effected. Thus the number of ribs and fastening bolts may be varied as required. The ribs need not necessarily extend down from the underside of the top wall of the cylinder block and may instead extend down from that position a little lower down which is reached by the upper piston ring on the associated piston when at the top dead centre position. The four ribs 30 are not equiangularly spaced in the described embodiment but it would be possible for them to be so.

I claim:

1. An engine of reciprocating piston type including a cylinder block, at least one cylinder within said cylinder block, a cylinder head, which is connected to said cylinder block and closes said cylinder, a respective piston reciprocally received in said at least one cylinder, said at least one cylinder being defined by a respective cylinder barrel which has a wall, a length and two ends and is integral with the remainder of said cylinder block only at both of said two ends, substantially the remainder of said length of said cylinder barrel being spaced from the remainder of said cylinder block in the radial direction of said cylinder by a gap which constitutes a coolant passage, said wall of said cylinder barrel affording a plurality of spaced portions of increased thickness extending over at least a proportion of its said length, said spaced portions of increased thickness constituting ribs extending substantially parallel to the axis of said associated cylinder and distributed around the periphery of said cylinder barrel.

2. An engine as claimed in claim 1 wherein said cylinder head is connected to said cylinder block by a plurality of threaded fastening bolts which are received in threaded bosses integral with said cylinder block.

3. An engine as claimed in claim 1 wherein each said portion of increased thickness has a thickness in the radial direction of said associated cylinder of 2 to 4 mm greater than that of the remainder of said cylinder barrel.

4. An engine as claimed in claim 1 wherein each said portion of increased thickness has a dimension in the circumferential direction of said associated cylinder of 5 to 15 mm.

5. An engine as claimed in claim 1 wherein said portions of increased thickness have a length in the axial direction of said associated cylinder of 20 to 50 mm.

* * * * *